US009622314B1

(12) United States Patent
Li

(10) Patent No.: US 9,622,314 B1
(45) Date of Patent: Apr. 11, 2017

(54) DIMMABLE AND COLOR TEMPERATURE-ADJUSTABLE LED LAMP

(71) Applicant: DongGuan City General Success Industrial Co. LTD, DongGuan (CN)

(72) Inventor: Ming Li, DongGuan (CN)

(73) Assignee: DONGGUAN CITY GENERAL SUCCESS INDUSTRIAL CO. LTD, Dongguan (CN)

( * ) Notice: Subject to any disclaimer, the term of this patent is extended or adjusted under 35 U.S.C. 154(b) by 0 days.

(21) Appl. No.: 15/136,740

(22) Filed: Apr. 22, 2016

(30) Foreign Application Priority Data

Mar. 18, 2016 (CN) ..... 2016 2 0209465

(51) Int. Cl.
*H05B 33/08* (2006.01)
*H05B 37/02* (2006.01)
(Continued)

(52) U.S. Cl.
CPC ..... *H05B 33/0845* (2013.01); *F21S 8/04* (2013.01); *F21V 1/143* (2013.01); *F21V 23/008* (2013.01); *F21V 29/70* (2015.01); *H05B 33/0857* (2013.01); *H05B 37/0272* (2013.01); *F21Y 2101/00* (2013.01); *F21Y 2101/02* (2013.01); *F21Y 2103/022* (2013.01); *F21Y 2103/33* (2016.08)

(58) Field of Classification Search
CPC ..... H05B 33/0845; H05B 33/0857; H05B 37/0272; H05B 37/0245; H05B 41/02; H05B 41/36; H05B 41/38; F21Y 2101/00; F21Y 2115/10; F21S 10/023; F21S 6/00; F21S 8/026; F21S 8/046; F21V 21/15
USPC ..... 315/246, 247, 291, 294, 307, 308; 362/145, 147, 404, 227, 240, 317, 362
See application file for complete search history.

(56) References Cited

U.S. PATENT DOCUMENTS 7,369,060 B2 * 5/2008 Veskovic ..... H05B 37/0254 340/12.52
7,619,539 B2 * 11/2009 Veskovic ..... H05B 37/0254 340/12.5
(Continued)

*Primary Examiner* — Thai Pham
*Assistant Examiner* — Borna Alaeddini
(74) *Attorney, Agent, or Firm* — Ming Chow; Sinorica, LLC

(57) ABSTRACT

The invention provides dimmable and color temperature-adjustable LED lamps in the LED illumination field, comprising: a ceiling disk; an LED light source assembly on the disk, comprising an LED board with double-color temperature lamp beads and a driver providing low-voltage power for the board; and a lampshade, wherein the driver comprises: a drive housing; and a driving circuit board comprising an input power line, a high-voltage input module, a wireless control module, a dimming module, a color temperature-adjusting module, a voltage-transformation module, a low-voltage output module and an output power line. The driver with dimming and color temperature-adjusting modules can select color temperature conversion and adjust light source brightness of each color temperature section. LED lamp beads with two different color temperatures are simultaneously distributed on the same board for the consumer to adjust and convert different color temperature functions, enriching flexible selection requirement for LED lamp functions.

20 Claims, 5 Drawing Sheets

(51) Int. Cl.

| | |
|---|---|
| ***F21V 1/14*** | (2006.01) |
| ***F21S 8/04*** | (2006.01) |
| ***F21V 29/70*** | (2015.01) |
| ***F21V 23/00*** | (2015.01) |
| *F21Y 101/02* | (2006.01) |
| *F21Y 103/02* | (2006.01) |
| *F21Y 103/33* | (2016.01) |
| *F21Y 101/00* | (2016.01) |

(56) References Cited

U.S. PATENT DOCUMENTS

| | | | | |
|---|---|---|---|---|
| 8,344,655 | B2 * | 1/2013 | Luk | H05B 33/0857 315/294 |
| 9,332,619 | B2 * | 5/2016 | Olsen | F21S 8/026 |
| 9,445,476 | B2 * | 9/2016 | Rodriguez | H05B 33/0842 |
| 2010/0327766 | A1 * | 12/2010 | Recker | H02J 9/02 315/291 |
| 2014/0265880 | A1 * | 9/2014 | Taipale | H05B 37/0263 315/158 |
| 2015/0130363 | A1 * | 5/2015 | Lee | H05B 33/0845 315/201 |

* cited by examiner

DIMMABLE AND COLOR TEMPERATURE-ADJUSTABLE LED LAMP

The current application claims a foreign priority to application number 201620209465.2 filed on Mar. 18, 2016 in China.

BACKGROUND OF THE INVENTION

Technical Field

The invention relates to the LED illumination field, and particularly, to a dimmable and color temperature-adjustable lamp.

Description of Related Art

For the currently produced ceiling lamp or single pendant lamp, especially export lamps, ON/OFF two-section switches are usually used for controlling illumination of the lamps. The circuit control board of some of the older lamps is still designed in the early domestic resistive and capacitive pressure relief way, or high-voltage lamp beads are designed for directly controlling the illumination of the lamp via a chip. With the resistive and capacitive pressure relief and the high-voltage chip for controlling illumination of the lamp, the product (domestic or export product) has potential safety hazard and unstable quality when in use, since it lacks safety performance. For example, poor FCC anti-interference, instantaneous voltage and current increase or lightning stroke easily damage the illumination function of the lamp. Therefore, the lamp hardly passes the five-level energy efficiency. In addition, when the ON/OFF switch is used for driving, it does not have dimming function, and thus the consumer cannot adjust according to the control brightness degree. The power cannot be efficiently saved, and the power consumption cost cannot be efficiently reduced. Therefore, it is inconvenient for market promotion.

The applicant submitted a domestic patent for invention with patent number of "201420710076.9" and invention name of "dimming LED lamp" on Nov. 24, 2014, which solves the above-mentioned problem, adjusts the brightness of the illuminating lamp and efficiently saves energy charge. However, the technology still has the following shortages: 1) the LED lamp is a monochromatic lamp with only dimming function and has single function; and 2) the switch structure is wire-controlled, which lacks control flexibility and cannot perform free switch control.

BRIEF SUMMARY OF THE INVENTION

The invention is aimed to solve the above shortfalls, and provides a dimmable and color temperature-adjustable LED lamp, which not only can select color temperature conversion through wireless control, but also can adjust the light source brightness of each color temperature section.

The purpose of the invention is realized by the following manner:

A dimmable and color temperature-adjustable LED lamp includes a ceiling disk, an LED light source assembly arranged on the ceiling disk, and a lampshade arranged under the LED light source assembly. The LED light source assembly consists of an LED board and a driver providing low-voltage power for the LED board. The LED board is provided with double-color temperature LED lamp beads; the driver includes a drive housing and a driving circuit board arranged inside the drive housing; the driving circuit board includes an input power line, a high-voltage input module, a wireless control module, a dimming module, a color-temperature adjusting module, a voltage transformation module, a low-voltage output module and an output power line; the LED lamp further includes an independent wireless remote control device; the wireless control module is used for performing wireless paired control with the wireless remote control device; the high-voltage input module is respectively connected with the input power line and the wireless control module; the wireless control module is respectively connected with the dimming module and the color temperature-adjusting module; the wireless control module is used respectively for controlling the illumination brightness and color temperature change of the double-color temperature LED lamp beads; the voltage transformation module is respectively connected with the wireless control module and the low-voltage output module; the output power line is connected to the low-voltage output module.

High-voltage power is input to the high-voltage input module via the input power line; the input voltage is regulated via the wireless control module; the high-voltage power is converted into safe low-voltage power via the voltage transformation module; and then the safe low-voltage power is output via the low-voltage output module and finally transmitted to the LED board via the output power line.

In the above-mentioned illustration, as a preferred solution, the dimming module consists of a silicon-controlled dimming circuit or a resistive dimming circuit or a PWM chip dimming circuit. The dimming module matches with a dimming switch. According to different national demands, for example, the switch adopting resistive dimming matches with a resistive dimming circuit, the switch adopting silicon-controlled dimming matches with a silicon-controlled dimming circuit, and the switch adopting PWM chip dimming matches with a PWM chip dimming circuit. After the switch is turned on to switch on the power, the dimming module in the LED product matches with the remote control panel of the product for normal operation and use.

In the above-mentioned illustration, as a preferred solution, the end of the output power line of the driver is provided with a male connector, and the LED board is provided with a female connector matching with the male connector. Instead of assembling in terminal connection way, assembling in a matching connection way of the male and female connectors saves labor cost and makes the circuit board more aesthetic.

In the above-mentioned illustration, as a preferred solution, the central section of the bottom of the ceiling disk is a plane protruding downward; the LED board and the driver are arranged on the bottom surface of the protruded plane; the LED board consists of more than two arc LED light bars; the double-color temperature LED lamp beads are uniformly arranged on the bottom surface of each LED light bar; and the LED light bars form a circular ring, thereby expanding the illumination area and saving cost and at the same time efficiently solving the shortage of the hidden dark space of the luminous surface. The driver is located at the center of the circular LED light bars, which can efficiently shorten the height of the ceiling disk, improve appearance, save packaging material and save transportation cost.

In the above-mentioned illustration, as a preferred solution, the edge of the protruded plane is provided with a counter bore for mounting the lampshade; the lampshade is an arc disk structure that is opened upward; and the opening of the lampshade is chucked in the counter bore in a matching manner. The reasonable design of the lampshade and the lamp holder yields good illumination effect.

In the above-mentioned illustration, as a preferred solution, the central section of the top of the ceiling disk protrudes upward to form a holding chamber that is opened downward; a mounting pillar extending downward vertically is arranged in the middle of the top of the holding chamber; the edge of the lower end of the ceiling disk expands outward to form a cover body integrated with the ceiling disk; the driver is penetrated by the mounting pillar and is fixed in the holding chamber; the LED board is a circular disk structure; the double-color temperature LED lamp beads are uniformly arranged on the bottom surface of the LED board; the LED board is penetrated by the mounting pillar and is fixed under the driver; and the LED board is located in the opening of the holding chamber.

In the above-mentioned illustration, as a preferred solution, the edge of the top of the holding chamber is provided with several air convection holes; and a heat sink panel penetrated by the mounting pillar is further arranged between the driver and the LED board. The air convection holes are directly located above the driver, the structure and the size are reasonably designed, and matching with the heat sink panel efficiently solves the heat dissipation problem of the LED and avoids abnormalities like dead lamp caused by the heat dissipation problem.

In the above-mentioned illustration, as a preferred solution, the lampshade consists of a transparent circular light barrier; and the light barrier is penetrated by the mounting pillar and is fixed via a fixed part. The light barrier is located under the LED board. Since the light barrier has a transparent structure, it can protect the LED board, can avoid the strong light from directly irritating the eyes, and has the function of appearance decoration.

In the above-mentioned illustration, as a preferred solution, the bottom end of the mounting pillar is provided with a cylindrical bottom cap.

The invention has the following beneficial effects:

1) The driver with dimming and color temperature-adjusting modules can select color temperature conversion and adjust light source brightness of each color temperature section. LED lamp beads with two different color temperatures are simultaneously distributed on the same board for the consumer to adjust and convert different color temperature functions, enriching flexible selection requirement for LED lamp functions;

2) The same LED lamp combines dimming and color temperature adjusting functions, and the user can directly convert selection according to requirements, thereby efficiently saving energy charge and improving market competitiveness;

3) High-voltage input and low-voltage output are realized by the high-voltage input module, the voltage transformation module and the low-voltage output module, thereby ensuring use safety; and 4) The color temperature and brightness can be controlled via the wireless remote control device, which brings convenience for the user to randomly remote control the LED lamp in an effective range in a room and increases technological content of the product.

In the figures: 1—ceiling disk; 2—lampshade; 3—LED light bar; 4—driver; 5—input power line; 6—high-voltage input module; 7—dimming module; 8—voltage transformation module; 9—low-voltage output module; 10—output power line; 11—fixed cover; 12—mounting pillar; 13—LED board; 14—light barrier; 15—air convection hole; 16—heat sink panel; 17—bottom cap; 18—double-color temperature LED lamp bead; 19—wireless remote control device; 20—wireless control module; and 21—color temperature-adjusting module.

DETAILED DESCRIPTION OF THE INVENTION

The invention is further described below in detail in conjunction with the drawings and the detailed description.

Embodiment 1

Figure 1:
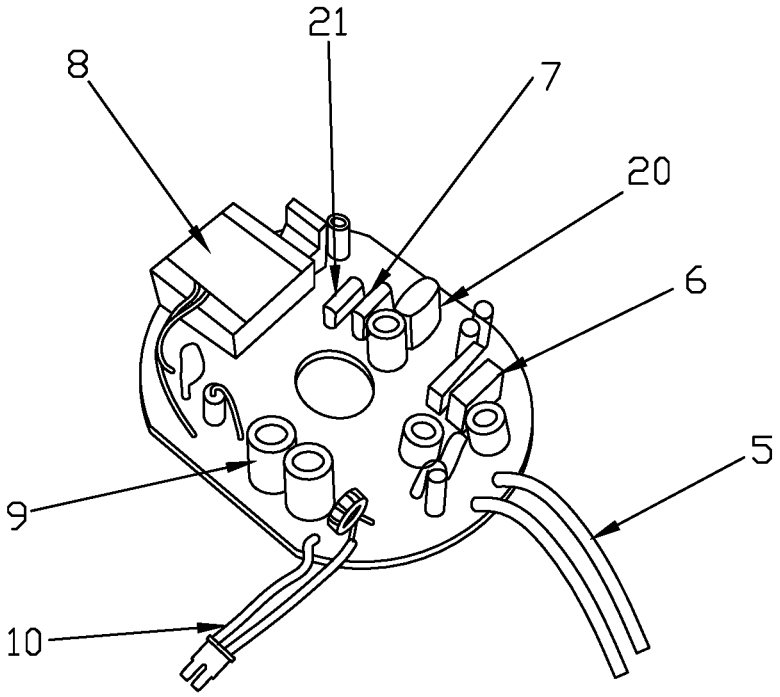
FIG. 1 is a structural schematic diagram of a driving circuit board of the invention.
Figure 2:
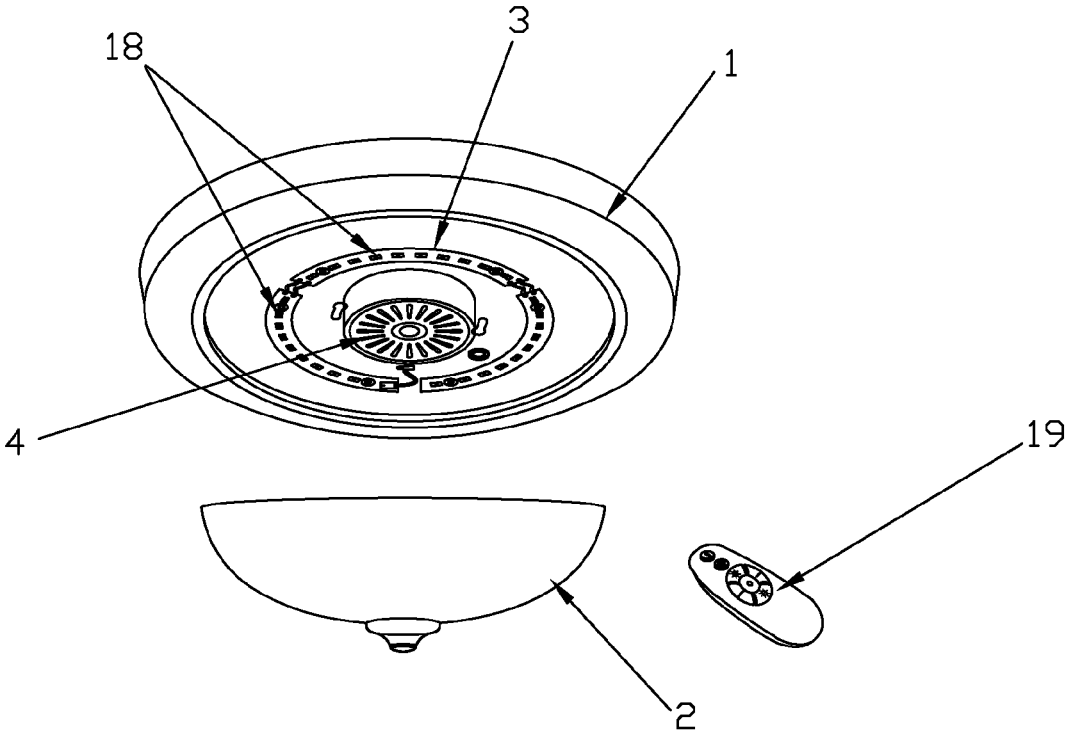
FIG. 2 is a partial structural exploded schematic diagram of an embodiment 1 of the invention.
Figure 3:
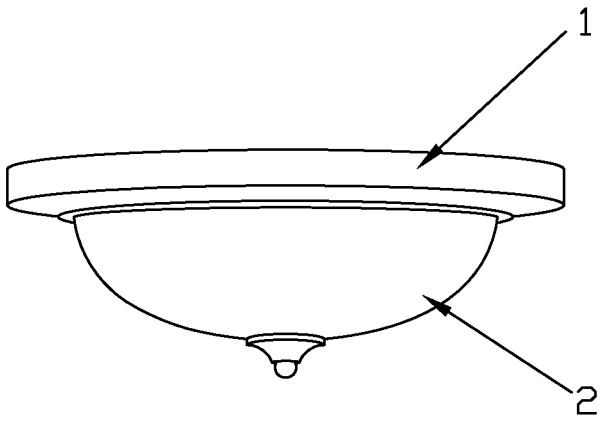
FIG. 3 is an integral structural schematic diagram of the embodiment 1 of the invention.

Referring to FIGS. 1-3, a dimmable and color temperature-adjustable LED lamp of the specific implementation includes a ceiling disk 1, an LED light source assembly arranged on the ceiling disk 1, and a lampshade 2 arranged under the LED light source assembly. The LED light source assembly consists of an LED board 13 and a driver 4 for providing low-voltage power for the LED board 13. The LED board 13 is provided with double-color temperature LED beads 18. This embodiment is designed as a ceiling lamp structure. The central section of the bottom of the ceiling disk 1 is a plane protruding downward. The LED board 13 and the driver 4 are arranged on the bottom surface of the protruded plane. The LED board 13 of this embodiment consists of three arc LED light bars 3. The double-color temperature LED lamp beads 18 are uniformly arranged on the bottom surface of each LED light bar 3. The LED light bars 3 form a circular ring. The driver 4 is located at the center of the circular LED light bars 3. The circular distribution of the LED light bars 3 can both expand the illumination area and save cost and at the same time efficiently solve the shortage of the hidden dark space of the luminous surface. The edge of the protruded plane is provided with a counter bore for mounting the lampshade 2; the lampshade 2 is an arc disk structure that is opened upward; and the opening of the lampshade 2 is chucked in the counter bore in a matching manner. The reasonable design of the lampshade 2 and the lamp holder yields good illumination effect.

The driver 4 of this embodiment includes a drive housing and a driving circuit board arranged inside the drive housing. The driver 4 outputs low-voltage power. The end of the output power line 10 of the driver 4 is provided with a male connector. The LED board 13 is provided with a female connector matching with the male connector. Instead of assembling in terminal connection way, assembling in a matching connection way of the male and female connectors saves labor cost and makes the circuit board more aesthetic.

In addition, in order to realize safe dimmable and color temperature-adjustable function, the driving circuit board includes an input power line 5, a high-voltage input module 6, a wireless control module 20, a dimming module 7, a color temperature-adjusting module 21, a voltage transformation module 8, a low-voltage output module 9 and an output power line 10. The LED lamp further includes an independent wireless remote control device 19. The wireless control module 20 is used for performing wireless paired control together with the wireless remote control device 19. The high-voltage input module 6 is respectively connected with the input power line 5 and the wireless control module 20. The wireless control module 20 is respectively connected with the dimming module 7 and the color temperature-adjusting module 21. The wireless control module 20 is used respectively for controlling the illumination brightness and color temperature change of the double-color temperature LED lamp beads 18. The voltage transformation module 8 is respectively connected with the wireless control module 20 and the low-voltage output module 9. The output power line 10 is connected to the low-voltage output module 9.

When powered on, high-voltage power is input to the high-voltage input module 6 via the input power line 5. The input voltage is regulated via the wireless control module 20. The high-voltage power is converted into safe low-voltage power via the voltage transformation module 8. Then, the safe low-voltage power is output via the low-voltage output module 9 and finally transmitted to the LED board 13 via the output power line 10. The LED board 13 is powered by the low-voltage power to ensure use safety.

Embodiment 2

Figure 4:
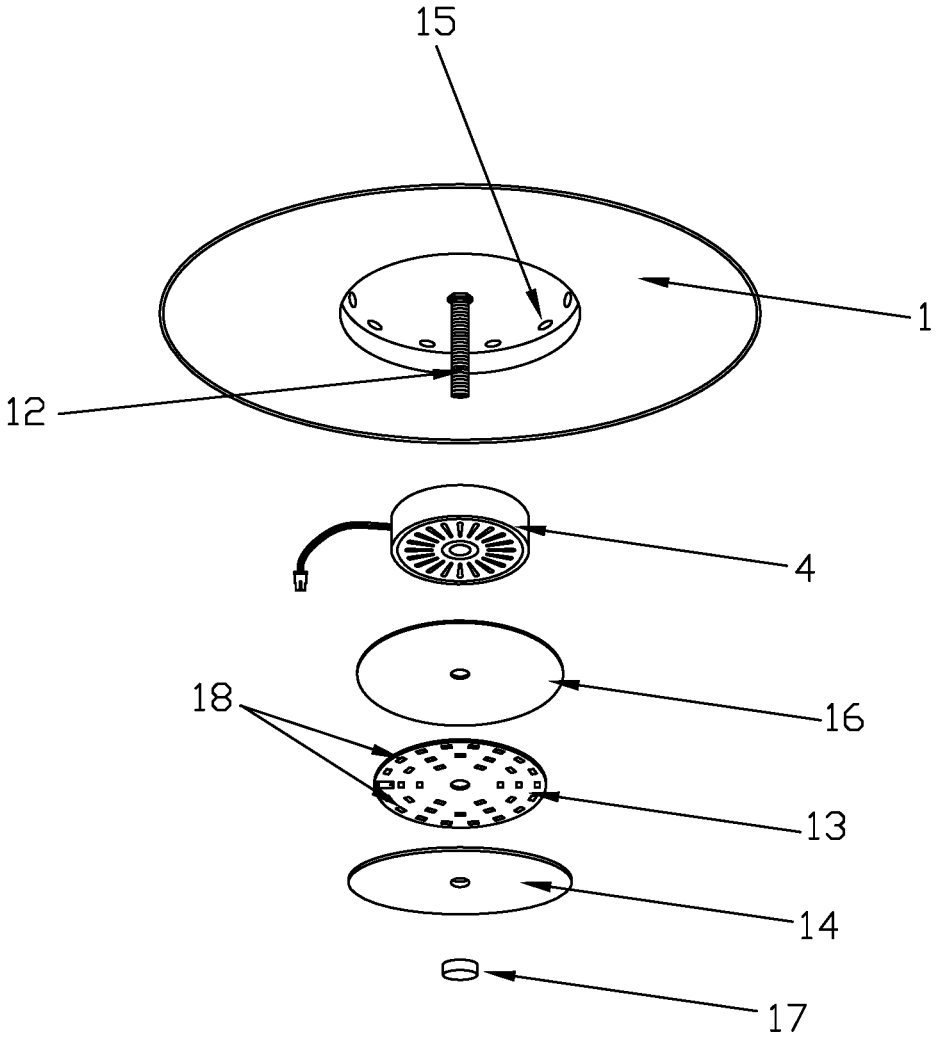
FIG. 4 is a structural exploded schematic diagram of an embodiment 2 of the invention.
Figure 5:
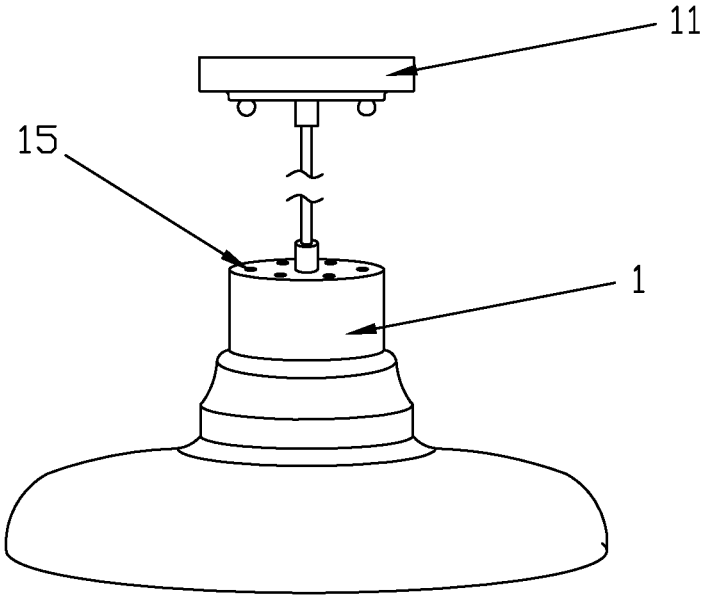
FIG. 5 is an integral structural schematic diagram of the embodiment 2 of the invention.

Referring to FIGS. 1, 4 and 5, the LED lamp includes a ceiling disk 1; an LED light source assembly arranged on the ceiling disk 1; and a lampshade 2 arranged under the LED light source assembly. The LED light source assembly consists of an LED board 13 and a driver 4 for providing low-voltage power for the LED board 13. The LED board 13 is provided with double-color temperature LED beads 18. This embodiment is designed as a single pendant lamp structure. While mounting, the single pendant lamp of this embodiment is directly mounted through the fixed cover 11 which is fixed to the top. The central section of the top of the ceiling disk 1 protrudes upward to form a holding chamber that is opened downward. A mounting pillar 12 extending downward vertically is arranged in the middle of the top of the holding chamber; the edge of the lower end of the ceiling disk 1 expands outward to form a cover body integrated with the ceiling disk 1. The driver 4 is penetrated by the mounting pillar 12 and is fixed in the holding chamber; the LED board 13 is a circular disk structure. The double-color temperature LED lamp beads 18 are uniformly arranged on the bottom surface of the LED board 13. The LED board 13 is penetrated by the mounting pillar 12 and is fixed under the driver 4. The LED board 13 is located in the opening of the holding chamber. The lampshade 2 of this embodiment consists of a transparent circular light barrier 14. The light barrier 14 is penetrated by the mounting pillar 12 and fixed via a fixed part. The light barrier 14 is located under the LED board 13. Since the light barrier has a transparent structure, it can protect the LED board 13, can avoid the strong light from directly irritating the eyes, and has the function of appearance decoration.

This embodiment has good heat dissipation effect. The edge of the top of the holding chamber is provided with several air convection holes 15. A heat sink panel 16 penetrated by the mounting pillar 12 is further arranged between the driver 4 and the LED board 13. The bottom end of the mounting pillar 12 is provided with a cylindrical bottom cap 17. The air convection holes 15 are directly located above the driver 4, the structure and the size are reasonably designed, and matching with the heat sink panel 16 efficiently solves the heat dissipation problem of the LED and avoids abnormality like dead lamp caused by the heat dissipation problem.

In addition, the structure for realizing dimming and color temperature adjusting function in this embodiment is the same as that in the embodiment 1. The driver 4 of this embodiment includes a drive housing and a driving circuit board arranged inside the drive housing. The driver 4 outputs low-voltage power. The end of the output power line 10 of the driver 4 is provided with a male connector. The LED board 13 is provided with a female connector matching with the male connector. Instead of assembling in terminal connection way, assembling in a matching connection way of the male and female connectors saves labor cost and makes the circuit board more aesthetic. The driving circuit board includes an input power line 5, a high-voltage input module 6, a wireless control module 20, a dimming module 7, a color temperature-adjusting module 21, a voltage transformation module 8, a low-voltage output module 9 and an output power line 10. The LED lamp further includes an independent wireless remote control device 19. The wireless control module 20 is used for performing wireless paired control together with the wireless remote control device 19. The high-voltage input module 6 is respectively connected with the input power line 5 and the wireless control module 20. The wireless control module 20 is respectively connected with the dimming module 7 and the color temperature-adjusting module 21. The wireless control module 20 is used respectively for controlling the illumination brightness and color temperature change of the double-color temperature LED lamp beads 18. The voltage transformation module 8 is respectively connected with the wireless control module 20 and the low-voltage output module 9. The output power line 10 is connected to the low-voltage output module 9.

When powered on, high-voltage power is input to the high-voltage input module 6 via the input power line 5. The input voltage is regulated via the wireless control module 20. The dimming module 7 of this embodiment consists of a silicon-controlled dimming circuit or a resistive dimming circuit or a PWM chip dimming circuit. The high-voltage power is converted into safe low-voltage power via the voltage transformation module 8. Then, the safe low-voltage power is output via the low-voltage output module 9 and finally transmitted to the LED board 13 via the output power line 10. The LED board 13 is powered by the low-voltage power to ensure use safety. The driver 4 with the dimming module 7 and the color temperature-adjusting module 21 can select color temperature conversion and adjust light source brightness of each color temperature section. LED lamp beads with two different color temperatures are simultaneously distributed on the same LED board 13 for the consumer to adjust and convert different color temperature functions, enriching flexible selection requirement for LED lamp functions. The same LED lamp combines dimming and color temperature adjusting functions, and the user can directly convert selection according to requirements, thereby efficiently saving energy charge and improving market competitiveness.

The forgoing is further detailed illustration of the invention in conjunction with the specific preferred embodiment. The specific implementation of the invention cannot be considered as being limited to the illumination. For those skill in the art of the invention, many simple deductions or replacement can be made without departing from the idea of the invention and should be considered within the protection scope of the invention.

What is claimed is:

1. A dimmable and color temperature-adjustable LED lamp, comprising a ceiling disk, an LED light source assembly arranged on the ceiling disk and a lampshade arranged under the LED light source assembly, the LED light source assembly consisting of an LED board and a driver providing low-voltage power for the LED board, characterized in that: the LED board is provided with double-color temperature LED lamp beads; the driver comprises a drive housing and a driving circuit board arranged inside the drive housing; the driving circuit board comprises an input power line, a high-voltage input module, a wireless control module, a dimming module, a color-temperature adjusting module, a voltage transformation module, a low-voltage output module and an output power line; the LED lamp further comprises an independent wireless remote control device; the wireless control module is used for performing wireless paired control together with the wireless remote control device; the high-voltage input module is respectively connected with the input power line and the wireless control module; the wireless control module is respectively connected with the dimming module and the color temperature-adjusting module; the wireless control module is used respectively for controlling the illumination brightness and color temperature change of the double-color temperature LED lamp beads; the voltage transformation module is respectively connected with the wireless control module and the low-voltage output module; the output power line is connected to the low-voltage output module; high-voltage power is input to the high-voltage input module via the input power line; the input voltage is regulated via the wireless control module; the high-voltage power is converted into safe low-voltage power via the voltage transformation module; and then the safe low-voltage power is output via the low-voltage output module and finally transmitted to the LED board via the output power line.

2. The dimmable and color temperature-adjustable LED lamp according to claim 1, characterized in that: the dimming module consists of a silicon-controlled dimming circuit or a resistive dimming circuit or a PWM chip dimming circuit.

3. The dimmable and color temperature-adjustable LED lamp according to claim 2, characterized in that: the end of the output power line of the driver is provided with a male connector, and the LED board is provided with a female connector matching with the male connector.

4. The dimmable and color temperature-adjustable LED lamp according to claim 3, characterized in that: the central section of the bottom of the ceiling disk is a plane protruding downward; the LED board and the driver are arranged on the bottom surface of the protruded plane; the LED board consists of more than two arc LED light bars; the double-color temperature LED lamp beads are uniformly arranged on the bottom surface of each LED light bar; the LED light bars form a circular ring; and the driver is located at the center of the circular LED light bars.

5. The dimmable and color temperature-adjustable LED lamp according to claim 4, characterized in that: the edge of the protruded plane is provided with a counter bore for mounting the lampshade; the lampshade is an arc disk structure that is opened upward; and the opening of the lampshade is chucked in the counter bore in a matching manner.

6. The dimmable and color temperature-adjustable LED lamp according to claim 3, characterized in that: the central section of the top of the ceiling disk protrudes upward to form a holding chamber that is opened downward; a mounting pillar extending downward vertically is arranged in the middle of the top of the holding chamber; the edge of the lower end of the ceiling disk expands outward to form a cover body integrated with the ceiling disk; the driver is penetrated by the mounting pillar and is fixed in the holding chamber; the LED board is a circular disk structure; the double-color temperature LED lamp beads are uniformly arranged on the bottom surface of the LED board; the LED board is penetrated by the mounting pillar and is fixed under the driver; and the LED board is located in the opening of the holding chamber.

7. The dimmable and color temperature-adjustable LED lamp according to claim 2, characterized in that: the central section of the bottom of the ceiling disk is a plane protruding downward; the LED board and the driver are arranged on the bottom surface of the protruded plane; the LED board consists of more than two arc LED light bars; the double-color temperature LED lamp beads are uniformly arranged on the bottom surface of each LED light bar; the LED light bars form a circular ring; and the driver is located at the center of the circular LED light bars.

8. The dimmable and color temperature-adjustable LED lamp according to claim 7, characterized in that: the edge of the protruded plane is provided with a counter bore for mounting the lampshade; the lampshade is an arc disk structure that is opened upward; and the opening of the lampshade is chucked in the counter bore in a matching manner.

9. The dimmable and color temperature-adjustable LED lamp according to claim 2, characterized in that: the central section of the top of the ceiling disk protrudes upward to form a holding chamber that is opened downward; a mounting pillar extending downward vertically is arranged in the middle of the top of the holding chamber; the edge of the lower end of the ceiling disk expands outward to form a cover body integrated with the ceiling disk; the driver is penetrated by the mounting pillar and is fixed in the holding chamber; the LED board is a circular disk structure; the double-color temperature LED lamp beads are uniformly arranged on the bottom surface of the LED board; the LED board is penetrated by the mounting pillar and is fixed under the driver; and the LED board is located in the opening of the holding chamber.

10. The dimmable and color temperature-adjustable LED lamp according to claim 9, characterized in that: the edge of the top of the holding chamber is provided with several air convection holes; and a heat sink panel penetrated by the mounting pillar is further arranged between the driver and the LED board.

11. The dimmable and color temperature-adjustable LED lamp according to claim 10, characterized in that: the lampshade consists of a transparent circular light barrier; and the light barrier is penetrated by the mounting pillar and is fixed via a fixed part.

12. The dimmable and color temperature-adjustable LED lamp according to claim 11, characterized in that: the bottom end of the mounting pillar is provided with a cylindrical bottom cap.

13. The dimmable and color temperature-adjustable LED lamp according to claim 1, characterized in that: the central section of the bottom of the ceiling disk is a plane protruding downward; the LED board and the driver are arranged on the bottom surface of the protruded plane; the LED board consists of more than two arc LED light bars; the double-color temperature LED lamp beads are uniformly arranged on the bottom surface of each LED light bar; the LED light bars form a circular ring; and the driver is located at the center of the circular LED light bars.

14. The dimmable and color temperature-adjustable LED lamp according to claim 13, characterized in that: the edge of the protruded plane is provided with a counter bore for mounting the lampshade; the lampshade is an arc disk structure that is opened upward; and the opening of the lampshade is chucked in the counter bore in a matching manner.

15. The dimmable and color temperature-adjustable LED lamp according to claim 1, characterized in that: the central section of the top of the ceiling disk protrudes upward to form a holding chamber that is opened downward; a mounting pillar extending downward vertically is arranged in the middle of the top of the holding chamber; the edge of the lower end of the ceiling disk expands outward to form a cover body integrated with the ceiling disk; the driver is penetrated by the mounting pillar and is fixed in the holding chamber; the LED board is a circular disk structure; the double-color temperature LED lamp beads are uniformly arranged on the bottom surface of the LED board; the LED board is penetrated by the mounting pillar and is fixed under the driver; and the LED board is located in the opening of the holding chamber.

16. The dimmable and color temperature-adjustable LED lamp according to claim 15, characterized in that: the edge of the top of the holding chamber is provided with several air convection holes; and a heat sink panel penetrated by the mounting pillar is further arranged between the driver and the LED board.

17. The dimmable and color temperature-adjustable LED lamp according to claim 16, characterized in that: the edge of the top of the holding chamber is provided with several air convection holes; and a heat sink panel penetrated by the mounting pillar is further arranged between the driver and the LED board.

18. The dimmable and color temperature-adjustable LED lamp according to claim 17, characterized in that: the lampshade consists of a transparent circular light barrier; and the light barrier is penetrated by the mounting pillar and is fixed via a fixed part.

19. The dimmable and color temperature-adjustable LED lamp according to claim 18, characterized in that: the bottom end of the mounting pillar is provided with a cylindrical bottom cap.

20. The dimmable and color temperature-adjustable LED lamp according to claim 16, characterized in that: the lampshade consists of a transparent circular light barrier; and the light barrier is penetrated by the mounting pillar and is fixed via a fixed part.

* * * * *